US005839624A

United States Patent [19]

Parsons

[11] Patent Number: 5,839,624

[45] **Date of Patent: *Nov. 24, 1998**

[54] HORIZONTAL RELEASE AEROSOL CANISTER

[75] Inventor: Kevin L. Parsons, Appleton, Wis.

[73] Assignee: Armament Systems and Procedures, Inc., Appleton, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 632,907

[22] Filed: Apr. 16, 1996

[51] Int. Cl.[6] ..... B65D 83/14

[52] U.S. Cl. ..... 222/402.19

[58] Field of Search ..... 222/402.1, 402.19, 222/321.4, 376

[56] References Cited

U.S. PATENT DOCUMENTS

| | | | |
|---|---|---|---|
| 3,155,290 | 11/1964 | Venus, Jr. | 222/402.19 X |
| 3,658,215 | 4/1972 | Ewald | 222/402.19 X |
| 3,893,596 | 7/1975 | Beres et al. | 222/402.19 |
| 4,475,667 | 10/1984 | Ori et al. | 222/402.19 X |
| 5,509,581 | 4/1996 | Parsons | 222/402.11 X |

FOREIGN PATENT DOCUMENTS

| | | | |
|---|---|---|---|
| 40 6-199376 | 7/1994 | Japan | 222/402.19 |
| 855794 | 12/1960 | United Kingdom | 222/402.19 |
| 1045876 | 10/1966 | United Kingdom | 222/402.1 |

*Primary Examiner*—Kenneth Bomberg
*Attorney, Agent, or Firm*—McDonnell Boehnen Hulbert & Berghoff

[57] ABSTRACT

A fluid entry port is contained in the nozzle body of an aerosol canister for permitting continuous communication of the nozzle with the fluid charge regardless of orientation of the canister. The fluid entry port is used in combination with a typical dip tube configuration for drawing the fluid charge from the bottom of the container. The nozzle body and canister are configured to permit self-centering in the assembly process.

12 Claims, 2 Drawing Sheets

HORIZONTAL RELEASE AEROSOL CANISTER

BACKGROUND OF INVENTION

1. Field of Invention

The subject invention is generally related to aerosol canisters for use by the general consumer and is specifically directed to an aerosol canister adapted for use in releasing the spray along a substantially horizontal path along the longitudinal axis of the canister. The canister is particularly well suited for use in connection with a chemical irritant dispenser carrier which is designed to be readily located and oriented for use during a crisis situation, while minimizing the likelihood of misuse.

2. Discussion of the Prior Art

Chemical irritant dispensers are well known. Typically, the dispensers contain an aerosol pepper spray or teargas or other irritants, such as by way of example, the MACE brand of chemical irritant spray manufactured by MSI. Initially, such dispensers were designed for official use by law enforcement personnel and later by certain individuals as on the job protection, such as postal service workers, delivery men and the like. Because the dispensers were used by selected personnel, proper training minimized the chances for misuse and the specific dispensers did not necessarily take into account the ease of use and of storage. Many such dispensers are carried in holsters worn on the belt of the uniform of the wearer. An example of such a holster is shown and described in U.S. Pat. No. 4,588,116, entitled: "Holster for a Chemical Tear Gas Projector", issued to A. Litman of May 13, 1986.

Typically, prior art dispensers are fabricated from a standard aerosol canister, and are held in a vertical position when deployed, much like a handheld aerosol paint dispenser. As these dispensers gained acceptance in the general population, certain difficulties began to surface. For example, the standard aerosol canister must be properly aimed or it is possible to spray oneself with the contents. The actuator button generally includes an arrow for indicating the direction of spray. While satisfactory in many applications, the chemical irritant dispensers are typically used under stress and the requirement for conscientious aiming is a significant drawback. A number of devices have been developed to deal with this issue, see for example U.S. Pat. No. 3,602,399, entitled: "Non-Lethal Weapon Dispenser", issued to A. Litman on Aug. 31, 1971. None of these devices has met with widespread acceptance. This is primarily due to the fact that location, aiming and firing require a concentrated thought process which eliminates the element of surprise and the ability to quickly act when under duress.

More recently, this has been dealt with by attempting to incorporate the irritant dispenser in a common implement such as a key chain or the like. Examples of such devices are shown is U.S. Pat. No. 4,044,922, entitled: "Protective Device", issued to L. Bordelon on Aug. 30, 1977, and U.S. Pat. No. 4,449,474, entitled: "Personal Security Device", issued to J. Andersson et al on Feb. 10, 1987.

While such devices offer improvement over other configurations of such dispensers, they do not deal with two important issues. First, it is still necessary that the device be conscientiously aimed prior to using. Secondly, while common to provide a safety lock, it is not possible to unlatch the safety lock while holding the dispenser in an at ready position, requiring two separate hand positions to deploy the irritant. In order to expedite use, the lock is often left unlatched, creating a hazard of accidental release of the contents of the canister. Further, the key ring dispensers of the prior art are generally bulky and cumbersome, taking up substantial space in a purse, and not conducive to being carried on the person because of the bulky, unsightly appearance. In addition, the canisters of the prior art dispensers still require vertical positioning during use.

My copending patent application entitled: CHEMICAL IRRITANT DISPENSER; application Ser. No. 08/287,852; filed on Aug. 9, 1994 (now issued), and incorporated by reference herein, addresses many of these issues and provides a chemical irritant dispenser which is easy to carry and conceal as part of a commonly carried implement, while being simple to use in a spontaneous manner in a crisis. As there disclosed, the chemical irritant dispenser of my copending application also includes a safety lock which is simple to latch and unlatch, and is of a design to be easily carried on the person or in a purse or the like. The dispenser is adapted for use with a small aerosol cartridge or canister of approximately 3–5 inches in length and ½ inch in outer diameter. In addition, the container permits ready and inexpensive replacement of the aerosol canister, providing a dispenser with refillable charges.

One of the important features of the aforementioned chemical irritant dispenser is the ability to hold it in the palm of the hand with the hand upright and the canister in a horizontal position, wherein the spray is activated in a single safety latch and depression mode using the thumb while holding the dispenser in the palm of the hand. This permits release of the irritant while holding the dispenser in a horizontal position and further permits a key ring to be held in the normal position for use as a key holder while allowing for quick implementation of the dispenser without reorientation of the device. This configuration and firing position greatly minimizes the risk of accidental misfiring and greatly reduces the likelihood that the user can accidentally release the chemical at himself. The thumb is used to release the safety and activate the device in two separate actions to further minimize the accidental activation of the device.

While the device of my aforementioned application clearly resolves many of the issues which hindered the widespread acceptance of irritants as personal defense tools, the associated readily available canister technology has several drawbacks which, if overcome, would greatly enhance the acceptability of the irritant dispenser by the public. The aerosol canisters of the prior art are primarily designed to be used in an upright position, with the nozzle aimed at a right angle to the canister axis when a horizontal spray is desired. The small canisters used in my dispenser are also often used in an upward, vertical spray configuration in implements such as lighters and the like. When placed in a horizontal axis orientation such as is desirable for the irritant dispenser use, the fluid contents of the canister cannot be completely exhausted before the pressurized dispersant is released. While this does not interfere with the functionality of the dispenser, it increases the cost of use by requiring premature replacement of the canister.

In addition, as the canister is reduced in size, the cost of manufacture increases due to the tighter tolerances which must be met as a result of the miniaturization process. This problem is compounded by the length to diameter ratio. When products are impact extruded, the length to diameter ratio becomes critical in holding tolerances. Relieving tolerance ranges is desirable to make such products economically feasible. This further increases the cost of use and replacement of the canister in any application.

Therefore, it is desirable to provide an aerosol canister which is specifically designed for use in any orientation, and which is particularly adapted for use in a horizontal orientation. It is also desirable to provide an aerosol canister which may be manufactured in a smaller package than standard canisters without paying the typical miniaturization cost penalty.

SUMMARY OF THE INVENTION

The aerosol canister of the subject invention is specifically designed to be used in a horizontal orientation, but is equally well suited to be used in any desirable orientation, making the canister well suited for universal application. In addition, the canister is redesigned to permit miniaturization without the typical inherent cost penalty.

In the preferred embodiment of the invention, the canister is specifically adapted for use in a chemical irritant dispenser system such as that shown in my aforementioned copending patent application Ser. No. 08/287,852, and is intended to be oriented in a generally horizontal position during use. By placing a tap at the nozzle end, the fluid contents of the canister are assured of being upstream of the pressurized dispersant, assuring proper release of the contents when the nozzle is activated regardless of the orientation of the canister. Specifically, it has been found that the placement of a fluid entry port in the nozzle body permits continuous communication of the nozzle with the fluid charge regardless of orientation. In the preferred embodiment this is provided by an annular recess and aperture in the nozzle body. The presence of this opening does not cause a leak of dispersant into the nozzle when the canister is in the upright position because the amount of area exposed to the dispersant at the dip tube end of the canister is substantially greater than the open area of the annular recess and the pressurized dispersant moves the fluid into the nozzle to seal the annular recess from the gaseous dispersant. More importantly, the annular opening permits the liquid charge to flow into the nozzle chambers when the canister is held in a horizontal position or other nonvertical orientation. This creates a head of fluid in advance of the gaseous dispersant and assures that the nozzle will properly operate regardless of canister orientation.

The canister of the preferred embodiment also includes a larger than standard fluid tube to increase volume of fluid in the tube to provide better flow of the fluid from a horizontal position, increasing the efficacy of the dispenser. The broader, high volume spray increases the working zone of the dispenser.

In order to maintain cost control while reducing the size of the canister, the manufacturing tolerance ranges of the larger commercial canisters are preserved without any loss of dependability and repeatability. In the preferred embodiment this is achieved by incorporating self centering assembly components to assure proper sealing of the canister after it has been charged. This is particularly important when the canister is used in the preferred application for chemical irritant dispersants. Any leakage of the contents would release the irritant in an undesired manner, potentially causing discomfort to the user. In the preferred embodiment, the self-centering of the canister cap is accomplished by incorporating a reduced canister neck portion and an unrolled open end or mouth. The larger cap gasket or seal can then be seated anywhere on the reduced, unrolled mouth without fear of an improper seal. This permits looser tolerances in the manufacturing process without reducing the reliability of the seal.

The canister of the subject invention is particularly useful in any horizontal release application and is designed in such a manner to be cost competitive with larger prior art vertical configurations.

It is, therefore, an object and feature of the subject invention to provide a universal aerosol canister which is adapted to be used in any directional orientation.

It is another object and feature of the subject invention to provide an aerosol canister which is particularly well adapted for horizontal spray applications.

It is an additional object and feature of the subject invention to provide a horizontal release aerosol canister particularly well suited for chemical irritant dispenser applications.

It is a further object and feature of the subject invention to provide a miniature aerosol canister with the same reliability and dependability as standard size canisters without incurring a cost penalty.

Other objects and features will be readily apparent from the drawings and the following detailed description of the preferred embodiments.

DETAILED DESCRIPTION OF THE PREFERRED EMBODIMENT

Figure 1:
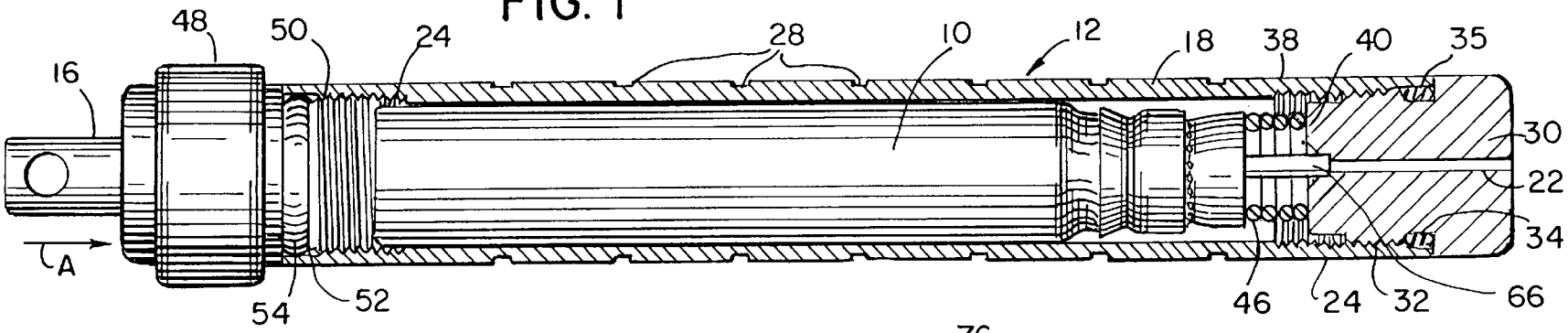
FIG. 1 is a longitudinal cross-section of an aerosol canister carrier including a replaceable aerosol canister or canister made in accordance with the teachings of the subject invention.
Figure 3:
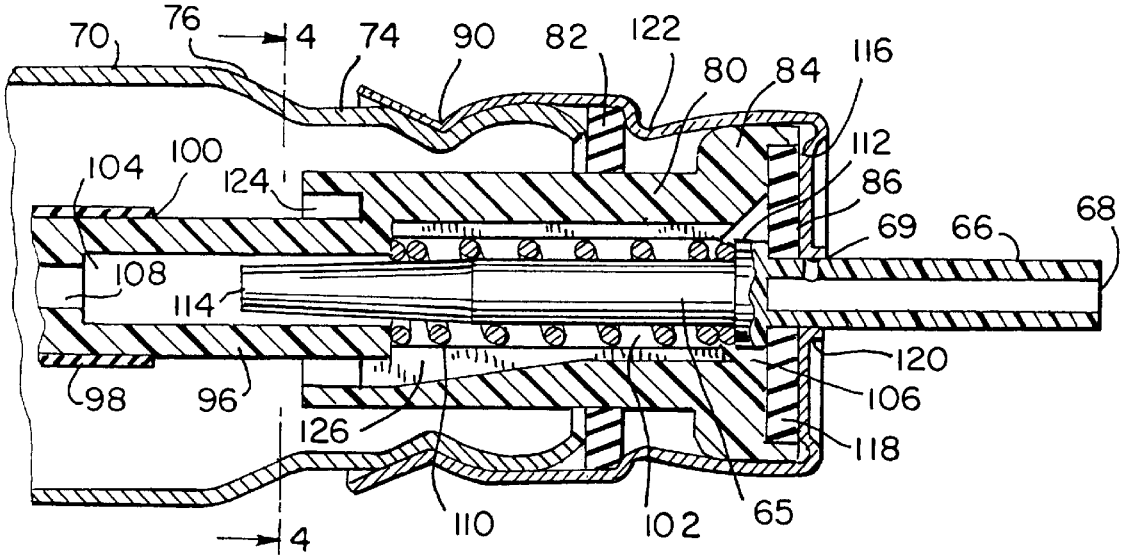
FIG. 3 is a partial, enlarged view of nozzle end of the canister, looking in the same direction as FIG. 2.

As shown in FIG. 1 of the drawings, the preferred embodiment of the aerosol canister 10 of the subject invention is shown installed in a chemical irritant dispenser assembly 12. The dispenser assembly is more fully described in my copending application entitled: CHEMICAL IRRITANT DISPENSER; application Ser. No. 08/287,852; filed on Aug. 9, 1994 (now issued), and incorporated by reference herein. In general the dispenser assembly 12 includes a dispenser body 18 defined by a generally cylindrical, open-ended tube having opposite internally threaded ends 24 and 26. The external surface of the tube may be ribbed, as at 28 to provide a better gripping surface. The tube 18 may be made of anodized aluminum and may be finished in any of a plurality of colors. End cap 30 includes the nozzle aperture 22 and is stepped to provide external threads 32 which mate with the tube threads at 24. An annular recess is provided at 34. When assembled as shown in FIG. 3, an O-ring 35 is positioned in the recess 34, and is received in the outer end of the threaded end 24. This provides a resilient friction lock for maintaining the cap 30 in firm assembled relationship with the tube 18. The opposite end of the end cap 30 includes a reduced, protruding boss 38, defining an annular channel 40 between the boss and the internal wall of tube 18. The nozzle aperture 22 is a through, axial bore terminating in an enlarged opening 44 in the boss area 38. The channel 40 defines a spring seat for the coil compression spring 46.

The opposite end cap 48 also includes a step portion having internal threads 50 for mating with the threads 26 in the tube. An annular recess 52 is provided for receiving the O-ring 54, to provide a resilient self-locking assembly when the cap 48 is tightened into tube 18. The cap 48 includes a through axial bore for receiving the actuator stem or pin 16.

The preferred embodiment of the canister 10 is approximately 3–5 inches in length and ½ inch in diameter. The canister includes a nozzle 66 which is operative to release the pressurized contents of the canister. Specifically, when the nozzle 66 is moved axially toward the canister 10, a valve is opened for releasing the contents of the canister through the nozzle aperture 68, as will be described. In the preferred embodiment, the outer end of the nozzle 66 is adapted to be received in an enlarged open end of the nozzle aperture 22 of the cap 30. The spring 46 is positioned between the canister 10 and the cap 30 to normally urge the nozzle away from the cap 30. The valve spring 110 (see FIG. 3) can also provide this function as a secondary function. Cap 48 is then threaded into the tube 18 to hold the canister in the assembled position of FIG. 1. When the stem 16 is depressed or advanced in the direction of arrow A (FIG. 1) the canister is advanced against the spring 46 for forcing the nozzle end 66 into the canister to release the canister contents. As the contents are released through the axial opening 68 of the nozzle, they are introduced into the coaxial dispenser nozzle 22 and released.

Figure 2:
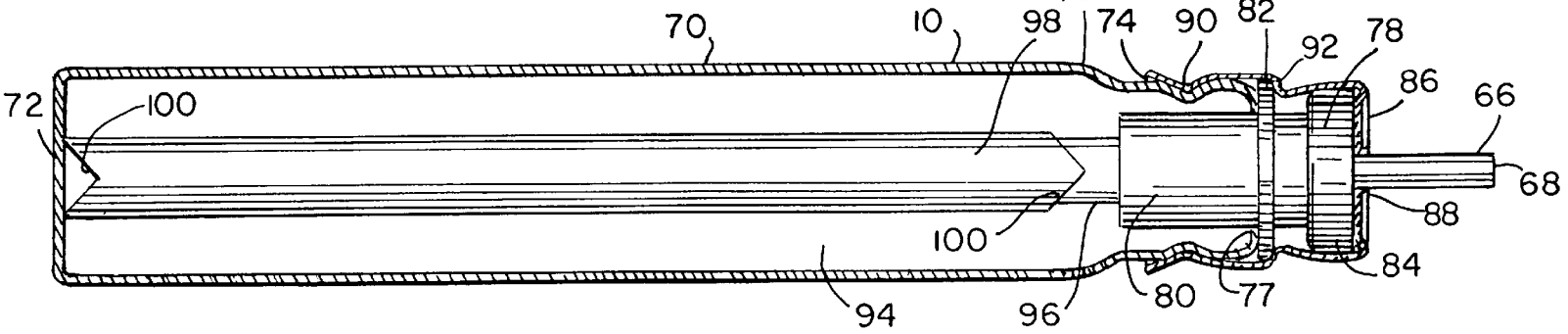
FIG. 2 is a longitudinal cross-section of the aerosol canister of FIG. 1.
Figure 4:
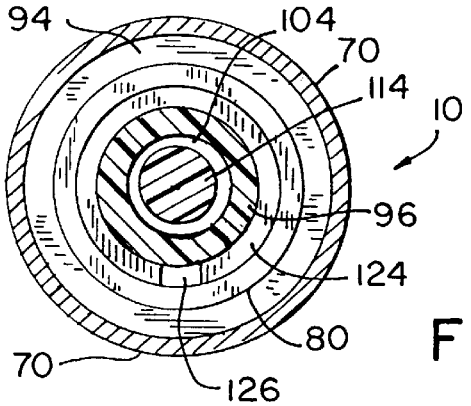
FIG. 4 is a cross-sectional view taken along the line 4—4 of FIG. 3.

As shown in FIGS. 2 through 4, the canister is uniquely configured to permit horizontal orientation of the dispenser. The canister assembly includes a formed, cylindrical container 70 having a closed bottom or end 72. The opposite, open end 74 is reduced at 76 and terminates in a radially inwardly tapered or extending edge or lip 77. The nozzle assembly 78 is includes two primary members comprising an integral nozzle tube 66 and body 80 which is inserted through the central aperture in a seal ring 82. The nozzle tube end 84 of the body 80 may be enlarged to facilitate assembly.

An end cap 86 includes a central aperture 88 for accommodating the nozzle tube 66. The end cap is adapted to be placed over the reduced end 74 of the tube 70 and crimped in assembled relationship therewith, as shown at 90. The seal ring 82 is seated against the lip 77 and is held thereagainst by the recess 92 provided in the end cap 86. The seal ring seals the interior chamber 94 of the cartridge against leakage. It will be noted that the tapered end 77 of the canister body engages the seal ring 82 generally at the midpoint of the ring, permitting maximum play between the seal ring and the canister during assembly.

It is an important feature of the invention that the lip or edge 77 be placed to permit maximum play in the assembly of the nozzle 80 to the canister 70. This assures a good seal between the nozzle assembly and the tube without requiring tight tolerances to be held, reducing the overall costs of manufacture and assembly. The reduced outer end 74 of the tube 70 also assures self centering of the nozzle and end cap assembly on the tube by making the outer end of the tube closer to the size of the standard nozzle body outer diameter.

The nozzle body 80 includes an integral stem 96 for receiving a fluid dip tube 98. In the preferred embodiment the dip tube is enlarged to provide a broader spray to be broadcast through the nozzle tube 66. In a typical configuration the dip tube is of a 0.040 inner diameter. In the preferred embodiment the inner diameter is increased to 0.140. Both ends of the tube 98 are cut in a V-configuration 100 to facilitate assembly of the dip tube on the stem 96 and to prevent a potential seal between the dip tube and the bottom of the can. The dip tube ends 100 are interchangeable.

The complete nozzle assembly is shown in FIG. 3. The main body 80 of the preferred embodiment is generally cylindrical with an enlarged head 84, and an integral, reduced stem 96. The stem is adapted to receive one end 100 of the dip tube 98. A through hole runs the entire length of the nozzle body and includes a spring chamber 102, a valve chamber 104, an expanding exit port 106 and an entry port or way 108.

The nozzle tube 66 is an integral member of the valve assembly 65 and includes a central bore or aperture 68 with a radial entry port 69. A compression spring 110 is placed in the spring chamber 102 and the valve assembly 65 is placed in the spring chamber 102 with the enlarged spring seat 112 in engagement with the spring 110. The valve stem 114 extends into the stem chamber 104 and the nozzle tube 66 extends outwardly from the expanding release chamber 106 of the nozzle body. The outer end of the enlarged head 84 of the nozzle body includes an annular seat 116 adapted for receiving a closure gasket 118. The closure gasket 118 includes a through hole 120 for accommodating the nozzle tube 66. The spring seat 112 serves as a closure element for closing the hole 120 and assuring a good seal when the nozzle is in the deactivated position of FIG. 3. The end cap 86 is placed over the nozzle assembly to maintain it in assembled relationship. Typically, the nozzle assembly is pre-assembled and the endcap is reduced at 122 to a smaller diameter than the enlarged head 84 of the body to complete the nozzle sub-assembly.

The nozzle sub-assembly is then mounted on the canister 70 by placing the sealing ring around the periphery of the nozzle body 80 and placing the end cap 86 over the reduced end 74 of the canister. The seal is seated against the upper, unrolled end 77 of the canister and the cap is secured in place as by crimping its perimeter into the canister as shown at 90.

In typical use, when the valve stem 114 is moved against the spring 110 the nozzle tube entry port 69 enters the release chamber 106 and the fluid is propelled by the dispersant through the dip tube 98 into the nozzle body through ports and chambers 108, 104, 102 and 106 and into the entry port 69 of the nozzle tube 66, where it is released through the bore 68.

In the preferred embodiment, the nozzle assembly includes an annular chamber 124 between the reduced nozzle stem 96 and the nozzle body 80. A generally longitudinal channel 126 communicates the annular chamber 124 with the spring chamber 102 and the opposite end of the chamber 124 is open into the canister 70. This permits universal orientation of the canister.

Specifically, once the canister is filled with fluid and a gaseous dispersant, the fluid will normally gravitate to the lowest point of the canister. In the prior art canisters, this was not a problem if the fluid is always between the dispersant and the nozzle so that the gaseous dispersant cannot escape through the nozzle ahead of the fluid. Thus, as long as the canister is held generally upright the fluid surrounds the open lower end of the dip tube 98 and when the nozzle is activated the pressurized dispersant forces the fluid up into the tube and through the nozzle. However, if the canister is held at an angle the dip tube is often exposed directly to the dispersant and when the nozzle is activated dispersant gases are released without the fluid charge.

It is an important feature of the subject invention that the canister may be held in any orientation without interfering with the fluid flow into the nozzle. It has been found that the placement of a fluid entry port in the nozzle body permits continuous communication of the nozzle with the fluid charge regardless of orientation. In the preferred embodiment this is provided by the annular recess 124 and the aperture 126 in the nozzle body 80. The presence of this opening does not cause a leak of dispersant into the nozzle when the canister is in the upright position because the amount of area exposed to the dispersant at the dip tube end of the canister is substantially greater than the open area of the annular recess and the pressurized dispersant moves the fluid into the nozzle to seal the annular recess from the gaseous dispersant. More importantly, the annular opening 124 permits the liquid charge to flow into the nozzle chambers when the canister is held in a horizontal position or other non-vertical orientation. This creates a head of fluid in advance of the gaseous dispersant and assures that the nozzle will properly operate regardless of canister orientation.

While certain features and embodiments of the invention have been described in detail herein, it will be readily understood that the invention encompasses all modifications and enhancements within the scope and spirit of the following claims.

What is claimed is:

1. An aerosol canister for use in any orientation including horizontally, the canister having a container with a first and a second end defining a chamber therebetween, the chamber being adapted to be charged with a chemical irritant fluid and a pressurized gaseous dispersant and an improved nozzle associated with the first end of the container for releasing the chemical irritant fluid when activated, the improved nozzle comprising:

a. a nozzle body having a through aperture, the nozzle body adapted for mounting on said first end of the container;

b. a valve assembly mounted in the through aperture of the nozzle body and movable between a closed position for sealing the chamber and an open position for releasing the chemical irritant fluid from the container;

c. a tubular member coupled to the nozzle body and in fluid communication with the valve assembly for introducing chemical irritant fluid at the second end of the container into the through aperture of the nozzle body; and d. the nozzle body further provided with a means for bypassing the tubular member to introduce the chemical irritant fluid adjacent said first end of the container directly into the through aperture of the nozzle body, the bypassing means including an annular recess about the nozzle body and an entry to the annular recess, the entry to the annular recess being located directly proximate to the first end of the container so as to allow the container to be substantially emptied of the chemical irritant fluid.

2. An aerosol canister as called for in claim 1, wherein the annular recess is positioned concentrically about the tubular member and proximate the valve assembly.

3. An aerosol canister as called for in claim 2, wherein the nozzle body further includes a valve chamber for housing the valve assembly and wherein the annular recess communicates the valve chamber with the container through the nozzle body.

4. An aerosol canister as called for in claim 2, wherein the tubular member is a stem extending outwardly from the nozzle body into the container.

5. An aerosol canister as called for in claim 4, wherein the nozzle body is of a generally circular cross-section of a first diameter and the stem is of a generally circular cross-section of a second diameter and is smaller than and generally concentric with the nozzle body and wherein the annular recess is about the periphery of the stem and has a cross-sectional area.

6. An aerosol canister as called for in claim 5, further including a hollow tube connected with the stem and extending substantially toward the second end of the container, the tube including a through aperture having a cross-sectional area that is larger than the cross-sectional area of the annular recess.

7. An aerosol canister as called for in claim 1, the container including a lip for receiving the nozzle body, and a sealing member for engaging the lip, the sealing member of a cross-sectional area larger than a cross-sectional area of the lip, whereby play is permitted between the lip and the sealing member during assembly.

8. An aerosol canister as called for in claim 7, the container of an elongated, generally cylindrical shape, wherein the first end is open and the second end is closed and further wherein the first open end is of reduced cross-section and terminates in an open edge for defining the lip.

9. An aerosol canister as called for in claim 8, further including an end cap adapted for receiving the nozzle body, the end cap of an elongated, generally cylindrical shape larger than the first open end of the container, whereby the end cap may be placed over the first open end of the container.

10. An aerosol canister as called for in claim 9, wherein the first open end of the container is of a reducing taper, whereby the end cap is self-centering as it is introduced onto the container.

11. An aerosol canister as called for in claim 5, wherein the nozzle body further includes a valve chamber portion longitudinally displaced from the annular recess, wherein the bypassing means further includes a longitudinally extending channel for communicating the annular recess with said valve chamber portion.

12. An aerosol canister as called for in claim 1, wherein the annular recess is dimensioned such that a seal of chemical irritant fluid is created in the annular recess when the canister is in an upright orientation to prevent the dispersant from leaking into the through aperture of the nozzle body.

* * * * *